US007114925B2

(12) United States Patent
Shaw

(10) Patent No.: US 7,114,925 B2
(45) Date of Patent: Oct. 3, 2006

(54) IMPELLER VANE CONFIGURATION FOR A CENTRIFUGAL PUMP

(75) Inventor: James G. Shaw, Draper, UT (US)

(73) Assignee: EnviroTech Pumpsystems, Inc., Salt Lake City, UT (US)

( * ) Notice: Subject to any disclaimer, the term of this patent is extended or adjusted under 35 U.S.C. 154(b) by 28 days.

(21) Appl. No.: 10/880,657

(22) Filed: Jun. 30, 2004

(65) Prior Publication Data

US 2005/0207891 A1 Sep. 22, 2005

Related U.S. Application Data

(60) Provisional application No. 60/483,964, filed on Jul. 1, 2003.

(51) Int. Cl.
*F04D 29/30* (2006.01)

(52) U.S. Cl. ..... 416/185; 416/228; 416/223 B; 415/121.1

(58) Field of Classification Search ..... 416/185, 416/228, 223 B; 415/121.1
See application file for complete search history.

(56) References Cited

U.S. PATENT DOCUMENTS 3,155,046 A 11/1964 Vaughan
3,774,323 A 11/1973 Vaughn
3,973,866 A 8/1976 Vaughan
4,840,384 A 6/1989 Dorsch
4,842,479 A 6/1989 Dorsch
5,076,757 A 12/1991 Dorsch
5,256,032 A 10/1993 Dorsch
5,456,580 A 10/1995 Dorsch
5,460,482 A 10/1995 Dorsch
5,460,483 A 10/1995 Dorsch
6,190,121 B1 2/2001 Hayward et al.
6,224,331 B1 * 5/2001 Hayward et al. ..... 415/121.1
6,406,255 B1 * 6/2002 Angelle ..... 415/121.1

* cited by examiner

*Primary Examiner*—Ninh H. Nguyen
(74) *Attorney, Agent, or Firm*—Morriss O'Bryant Compagni, PC

(57) ABSTRACT

A pump impeller for use in industrial pumps of the centrifugal type is disclosed in which the vanes of the pump impeller are particularly configured to maintain pumping efficiency as the vane wears over continuous use or operation of the pump. The impeller vane is configured to continuously present an aggressive cutting surface at the leading edge of the vane even though the vane may become degraded and worn through continuous use.

6 Claims, 2 Drawing Sheets

IMPELLER VANE CONFIGURATION FOR A CENTRIFUGAL PUMP

CROSS-REFERENCE TO RELATED APPLICATION

This application is a non-provisional application claiming priority to provisional patent application Ser. No. 60/483,964 filed Jul. 1, 2003.

BACKGROUND OF THE INVENTION

1. Field of the Invention

This invention relates to centrifugal pumps, particularly of the chopper type, and specifically relates to an impeller vane configuration particularly suited for use in a chopper pump.

2. Description of Related Art

Various industries involve or require the processing of solid waste material into a form that can be disposed of in a suitable manner. Certain solid wastes containing or comprising, for example, plastics, metals, animal byproducts and other hard or stringy materials present a particular challenge to processing that material into a disposable form. Therefore, centrifugal pumps of the type known as chopper pumps are typically employed in processing such solid waste material into a reduced size that can be disposed of or processed further as needed.

Impellers used in chopper pumps are characterized by having vanes that are structured with a cutting edge that is positioned to interact with one or more cutting members, generally termed cutter bars or anvils, located at or near the intake of the pump. The interaction of the cutting edge of the impeller vanes and the cutter bar, or anvil, causes cutting and chopping of the solid materials in the influent slurry, thereby reducing the size of the solids. The solids are further directed toward the vanes of the impeller from where the material is expelled out of the pump through a pump outlet.

A minute space exists between the cutting edge of the impeller vanes and the cutter bar which defines the area of interaction where the cutting and chopping of solids occurs. With continued operation of the chopper pump, the solids begin to wear down the cutting edge of the impeller and the minute space between the impeller vanes and the cutter bar widens. Action must then be taken to reduce the space again to improve the cutting action on the solids.

In conventionally known impellers used in chopper pumps, the impeller vanes are configured with a radially extending leading edge that, in radial (i.e., longitudinal) cross section, is curved at its outward extremity. The leading edge of the vane defines the cutting edge of the vane. Examples of such prior art impellers are disclosed in U.S. Pat. No. 4,842,479 to Dorsch and U.S. Pat. No. 5,460,483 to Dorsch. The curvature of the leading edge in such prior art impeller vanes changes as the cutting edge of the impeller vanes wears down. That is, the angle of the cutting edge becomes less aggressive rendering the cutting edge less effective in providing a cutting action on the solids.

Further, prior art impeller vanes have a body portion which is oriented parallel to the rotational axis of the impeller. As such, the vanes are less efficient in directing flow radially outwardly for expulsion of fluid and solids from the pump.

Thus, it would be advantageous in the art to provide a vane configuration for an impeller used in centrifugal pumps, and especially chopper pumps, which is structured with a cutting edge that does not lose its cutting efficacy as the impeller wears down, and one which is configured to improve fluid flow through the impeller.

BRIEF SUMMARY OF THE INVENTION

In accordance with the present invention, an impeller vane configuration for use in centrifugal pumps, especially chopper pumps, is provided with a cutting edge that is particularly structured to retain an aggressive profile as the impeller wears down with use, and is further configured with a vane body that improves the hydraulics of the pump by more efficiently directing influent from an axial flow to a radial flow for expulsion from the pump.

The impeller vane of the present invention is structured with a leading edge that has a cutting edge for effecting cutting of solids. The leading edge of the vane is angled such that as the impeller, and consequently the vanes, begin to wear with use, the cutting edge retains an aggressive cutting profile. As such, the impeller enjoys a longer operating life while consistently and continuously providing efficient cutting of entrained solids.

Additionally, the impeller vane of the present invention is configured with a leading surface for contacting fluid and the solids that enter into the impeller after being chopped or cut. The leading surface of the vane is especially configured at an angle to the rotational axis of the impeller so that fluid entering the impeller is more efficiently moved radially outwardly for expulsion from the pump. As a result, flow efficiencies in the pump are improved over prior art impeller configurations.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
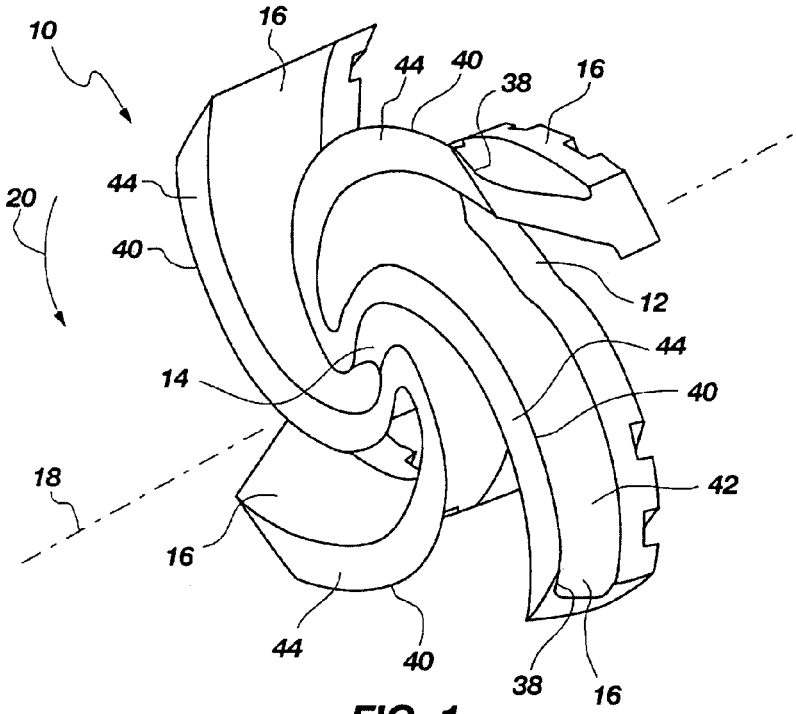
FIG. 1 is a perspective view of a pump impeller of the present invention.

FIG. 1 illustrates an impeller 10 which incorporates the vane configuration of the present invention. In general, the impeller 10 is structured with a central hub 12 which provides means for securing the impeller 10 to the drive shaft of a pump. The impeller 10 is also configured with an eye 14 which is oriented toward the inlet of a pump to receive influent entering the pump. A plurality of vanes 16 extend radially outwardly from the central hub 12 of the impeller 10.

Figure 2:
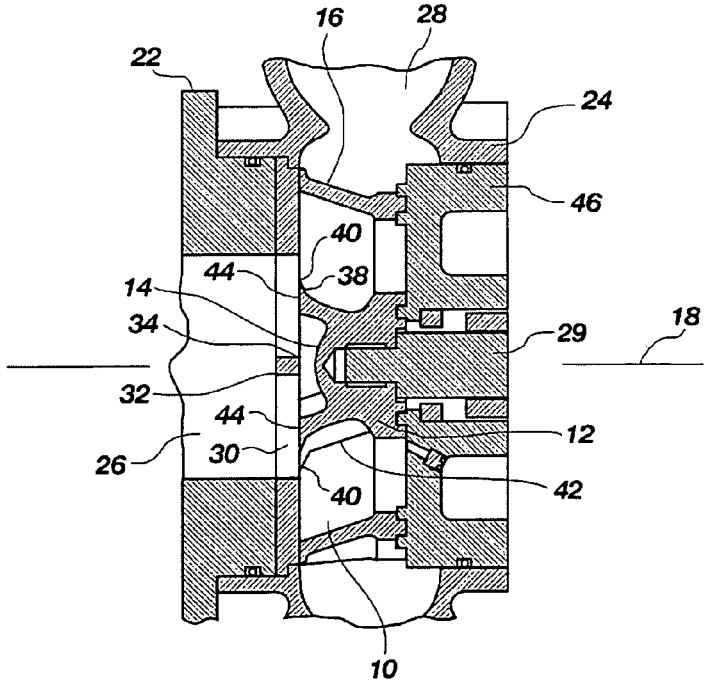
FIG. 2 is a partial view in longitudinal cross section of a centrifugal chopper pump illustrating the relative positions of the pump impeller and cutter bar of the pump.

FIG. 2 depicts the position of the impeller 10 within a pump 22 to better illustrate the operational features of the impeller. The pump 22 conventionally comprises a pump casing 24 having an inlet 26 and an outlet 28. The impeller 10 is positioned within the pump casing 24 and is oriented to receive fluid entering through the pump inlet 26. The impeller 10 is also oriented relative to the pump outlet 28 to expel fluid and entrained solids outwardly toward the pump outlet 28. The hub 12 of the impeller 10 is oriented and structured to attach to the drive shaft 29 of the pump 22.

In centrifugal pumps of the chopper type, a chopper plate 30, also referred to as an intake plate, is housed within the pump casing 24 and is positioned between the pump inlet 26 and the impeller 10. The chopper plate has one or more cutter bars 32 that have a cutting surface 34 positioned to interact with the vanes 16 of the impeller 10 as the impeller 10 rotates.

Referring again to FIG. 1, it can be seen that each vane 16 is structured with a leading edge 38 which provides a cutting edge 40 to the vane 16. Referring again to FIG. 2, it can be seen that the cutting edge 40 of the impeller vanes 16 is positioned adjacent the cutting surface 34 of the cutter bar 32 so that as the impeller 10 rotates about a central axis 18 in the direction of arrow 20 (FIG. 1), the cutting edge 40 of each vane 16 in turn sweeps past the cutting surface 34 of the cutter bar 32. The interaction between the cutting edge 40 of the vane 16 and the cutting surface 34 of the cutter bar 32 cuts solid materials passing therebetween.

A minute space exits between the suction end surface 44 of each vane 16 and cutting surface 34 of the cutter bar 32 which, as explained further below, expands as the impeller vanes 16 wear from continuous use. To assure continued cutting efficiency, the space between the suction end surface 44 of the vanes 16 and the cutter bar 32 needs to be maintained in sufficiently close tolerance to provide effective cutting or chopping of the solids.

The fluid and entrained solids entering into the impeller 10 flows into the areas between the vanes 16 and where the fluid encounters a leading surface 42 of the vane 16. The fluid and chopped solids are eventually redirected radially outwardly for expulsion from the pump by contact with the leading surface 42 of the vane 16, as explained more fully hereinafter.

It should be noted that the impeller 10 shown in FIG. 1 is of a type that does not have a back, or shroud, integrally formed as part of the impeller 10. An impeller of the type shown in FIG. 1 would be positioned adjacent a back plate 46 as shown in FIG. 2, or against a rear portion of the pump casing. The vane configuration of the present invention may also be incorporated in an impeller of the type having a shroud or back plate, as shown in FIG. 4.

Figure 4:
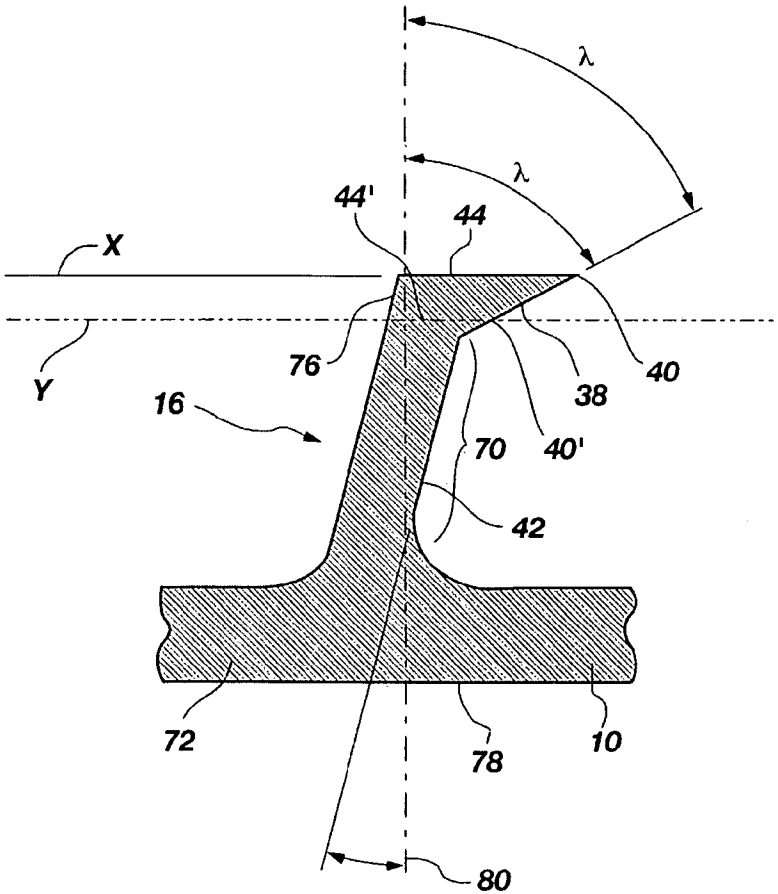
FIG. 4 is a view in longitudinal cross section of an impeller vane of the present invention.
Figure 3:
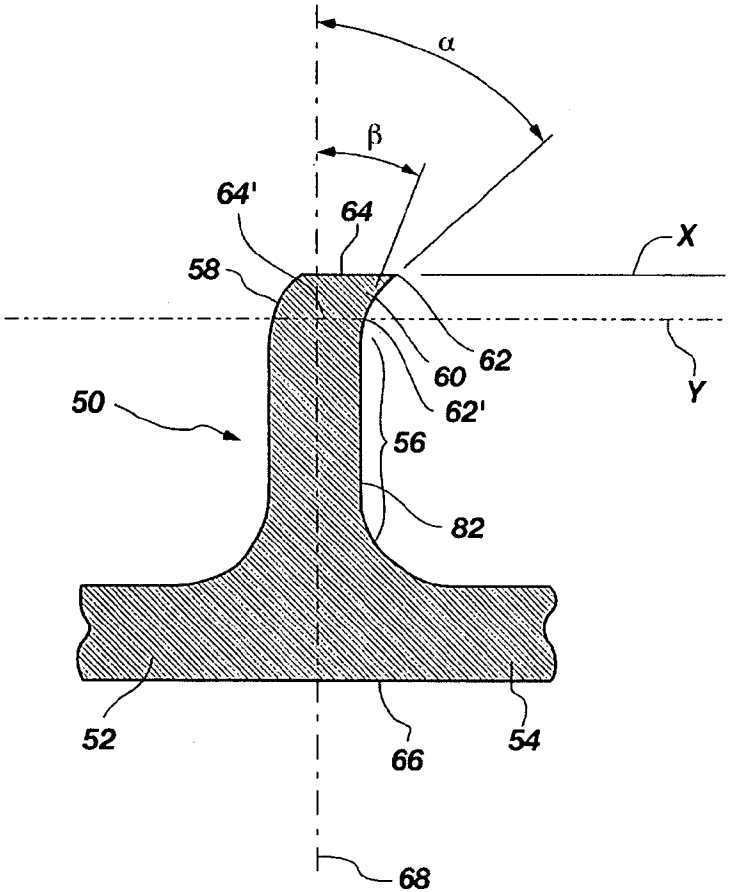
FIG. 3 (PRIOR ART)
FIG. 3 is a view in longitudinal cross section of a prior art impeller vane.

Having described the operational positioning of the pump impeller 10 within a chopper type pump, FIGS. 3 and 4 illustrate by comparison of the prior art vane with the present invention, how pumping and cutting efficiencies are improved with the pump impeller vane configuration of the present invention.

FIG. 3 illustrates in longitudinal cross section the configuration of a vane 50 of a prior art impeller 52. The vane 50 is shown to extend outwardly from a back plate or shroud 54. The vane 50 generally comprises a body portion 56 and a vane tip 58. In this prior art vane 50, the vane tip 58 that is generally curved in the direction of rotation of the impeller 52, thereby providing a curved leading edge 60. A cutting edge 62 is formed at the outward extremity of the leading edge 60 of the vane tip 58. In use, the suction end surface 64 of the vane tip 58 travels along an chopper plate to effect cutting of solids, as previously described.

FIG. 3 further illustrates that when the impeller 52 is new, the suction end surface 64 of the vane 50 extends a defined distance, represented by the line designated "X," from the drive end surface 66 of the impeller 52. Thus, when the impeller 50 is new, the cutting edge 62 of the vane 50 presents an initial cutting angle $\alpha$, which is defined between the slope of the curved leading edge 60 of the vane 50 and the axis 68 of rotation of the impeller 52.

With extended operation of the pump, the suction end surface 64 of each vane 50 becomes progressively worn as it interacts with the cutter bar, or other cutting elements, of the pump and the space between the suction end surface 64 and the cutting surface 34 of the cutter bar 32 (FIG. 1) widens, as previously described. It then becomes necessary to adjust the elements of the pump (e.g., the impeller and/or intake plate) to decrease the width of the resulting gap and to bring the suction end surface 64 of the vanes 50 into proximity again with the cutter bar. With continued operation of the pump and subsequent adjustments to reduce the gap, the vane tip 58 of each vane 50 wears down to a point, represented by the line designated "Y," where the resulting suction end surface 64' is less distanced from the drive end surface 66 of the impeller 52.

Given the curved profile of the leading edge 60 of the vane tip 58 as shown in FIG. 3, the wearing down of the vane tip 58 during extended use of prior art impeller 52 produces a worn cutting edge angle $\beta$ which is less aggressive than the initial cutting edge angle $\alpha$. Therefore, though the pump elements may be adjusted to reduce the space between the impeller 52 and the cutting surface 34 of the cutter bar 32, the cutting efficiency of the impeller 52 is not appreciably improved due to the loss of aggressiveness in the profile of the cutting edge 62 of the vanes 50. Consequently, the pump must be taken off line and the impeller 52 replaced, thereby increasing costs.

The vane configuration of the present invention, as shown in FIG. 4, overcomes the described problems encountered with prior art vanes by providing a consistently and continuously aggressive cutting edge profile as the pump is operated, thereby extending the life of the impeller while maintaining optimal cutting and chopping action.

The vane 16 of the present invention, shown in FIG. 4, comprises a body portion 70, which extends outwardly from a shroud 72 of the impeller 10, and a vane tip 76 having a leading edge 38 the outward extremity of which defines a cutting edge 40. Th suction end surface 44 of the vane 16 is structured to move along or interact with a cutting element, such as a cutter bar as previously described, to effect a cutting and chopping action on solids positioned between the cutter bar 32 and the cutting edge 40 of the vane 16. The leading edge 38 of the vane tip 76 presents a flattened and angled profile from the cutting edge 40 to the body portion 70 of the vane 16.

It can be seen from FIG. 4 that when the impeller 10 is new, the suction end surface 44 of the vane 16 is spaced a defined distance from the drive end surface 78 of the shroud 72, as represented by the line designated "X." The drive end surface 78 of the shroud 72 is perpendicular to the axis 80 of rotation of the impeller 10. When new, the vanes 16 present an initial cutting angle $\lambda$, which is defined between the angle of the leading edge 38 and the axis 80 of rotation of the impeller 10.

It can further be seen that as the vanes 16 of the impeller 10 become worn with use and the resulting suction end surface 44' is worn away, as represented by the line designated "Y," the worn cutting angle $\lambda$ of the resulting cutting edge **4*o*' remains the same as the initial cutting angle $\lambda$, even following adjustment to reduce the widening gap between the impeller 10 and cutter bar 32, due to the angled profile of the leading edge 38. Thus, the vane configuration of the present invention provides a consistent and continuously aggressive cutting edge 40 and cutting angle $\lambda$ as the impeller 10 becomes worn, thereby extending the life of the impeller 10** and maintaining the cutting and chopping efficiencies of the pump.

A further improvement in pump operation is provided by the vane configuration of the present invention by virtue of the angled profile of the vane body 70. Referring again to the prior art vane configuration shown in FIG. 3, it can be seen that the vane body 56 is substantially parallel to the axis 68 of rotation of the impeller 52. As such, the prior art vane 50 provides a leading surface 82 which is substantially parallel to the axis 68 of rotation. Fluid entering the prior art impeller 52 moves axially toward the shroud 54 and must then travel the distance to impact the leading surface 82 of the vane body 56 before the fluid can be redirected radially to move along the leading surface 82 of the vane 50 for expulsion from the pump.

In the vane configuration of the present invention, the vane body 70 is angled relative to the axis 80 of rotation of the impeller 10, thereby providing a leading surface 42 that is also oriented at an angle to the axis 80 of rotation. As fluid enters the impeller 10 in an axial direction toward the shroud 72, the fluid is directed into the impeller 10 and toward the leading surface 42 of the vane 16. The angled vane body 70 improves the containment of the fluid within the impeller 10 by providing a slight axial force to the fluid, along with the radial force for expulsion of fluid from the pump. Consequently, a pump which employs the vane configuration of the present invention has improved hydraulics as compared with pumps which employ vane configurations of the prior art.

The impeller vane of the present invention is especially suited for use in centrifugal pumps of the chopper type to consistently and continuously provide an aggressive cutting edge for cutting or chopping of entrained solids. The impeller vane may be employed, however, with different types of pumps and those of skill in the art will understand from the description herein how to adapt the impeller vane to the required application and/or pump. Hence, reference herein to specific details of a pump or to the impeller and impeller vanes is by way of example and not by way of limitation.

What is claimed is:

1. A pump impeller for use in a centrifugal pump, comprising:

an central hub providing structure for securement to a drive shaft, said central hub having an axis of rotation;

at least one vane extending radially from said hub, said at least one vane further comprising:

a body positioned to extend axially from a drive end surface of said impeller; and a vane tip extending from said vane body oriented at an angle to said rotational axis, said vane tip having a leading edge and a cutting edge at the outward extremity of said leading edge, said leading edge having an angled surface oriented at an angle to said axis such that as said vane tip and cutting edge wear with use, said angled surface maintains the same angle of orientation to said axis.

2. The pump impeller of claim 1 further comprising a shroud extending from proximate said central hub.

3. The pump impeller of claim 1 further comprising a shroud extending from proximate said central hub.

4. A pump impeller for a centrifugal pump, comprising:

a central hub;

an axis extending through said hub;

a plurality of vanes extending radially from said central hub, each said vane having an axially extending vane body and a vane tip extending from said vane body, wherein said vane body has a leading surface that is oriented at an angle to said axis and said vane tip comprises a leading edge having a sloped linear surface that is oriented at an angle to said axis; and a cutting edge positioned at the outward extremity of said leading edge or each said plurality of vanes.

5. The pump of claim 4 further comprising a shroud.

6. A vane for a pump impeller, comprising:

a vane body extend outwardly from a drive end surface, said vane body having a leading surface that is oriented at an acute angle to said drive end surface;

a vane tip extending from said vane body in a direction away from said drive end surface, said vane tip having a leading edge having a slope that is angled from said leading surface of said vane body; and a cutting edge positioned at an outward extremity of said leading edge.

* * * * *